United States Patent [19]

Wright et al.

[11] 4,050,113

[45] Sept. 27, 1977

[54] VACUUM CLEANERS

[76] Inventors: Gordon Thomas Wright, 55 Windemere Avenue, Burnley, Lancashire, England; Eric George Doubleday, am Kraherwald 167, D-7000 Stuttgart-West, Germany

[21] Appl. No.: 650,967

[22] Filed: Jan. 21, 1976

[30] Foreign Application Priority Data

Jan. 24, 1975 United Kingdom ..... 3287/75

[51] Int. Cl.[2] ..... A47L 9/00

[52] U.S. Cl. ..... 15/315; 15/323

[58] Field of Search ..... 15/314, 315, 331, 334, 15/335, 323

[56] References Cited

U.S. PATENT DOCUMENTS

| | | | |
|---|---|---|---|
| 2,504,846 | 4/1950 | Kirby | 15/335 X |
| 2,867,833 | 1/1959 | Duff | 15/323 |
| 3,110,922 | 11/1963 | Senne | 15/315 X |
| 3,464,859 | 9/1969 | Hamrick | 15/315 X |
| 3,520,725 | 7/1970 | Hamrick | 15/315 X |
| 3,568,240 | 3/1971 | Hamrick | 15/314 |
| 3,599,273 | 8/1971 | Shirayanagi et al. | 15/323 X |

*Primary Examiner*—Christopher K. Moore
*Attorney, Agent, or Firm*—Holman & Stern

[57] ABSTRACT

A vacuum cleaner is provided with a storage chamber in which a flexible hose, used to connect the usual dust collection tools to the cleaner, can be stored when not in use. In a preferred embodiment, the hose can be sucked into the storage chamber when it is desired to store same.

5 Claims, 6 Drawing Figures

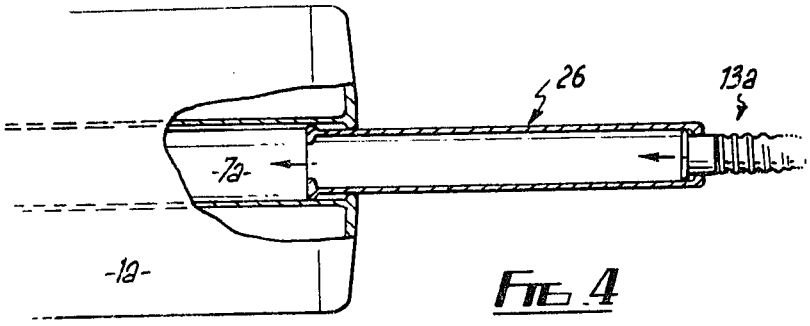
FIG. 4
FIG. 6
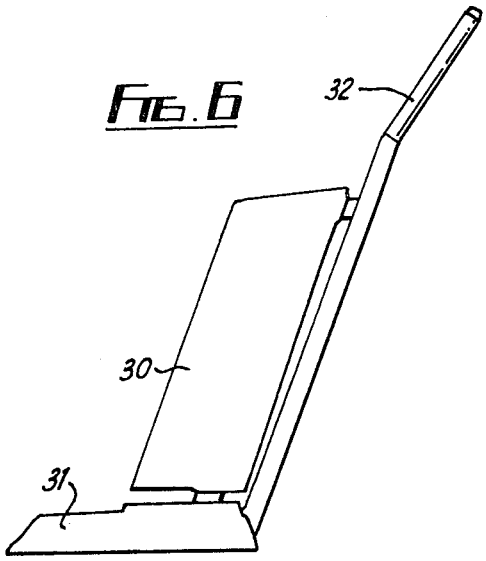
FIG. 5
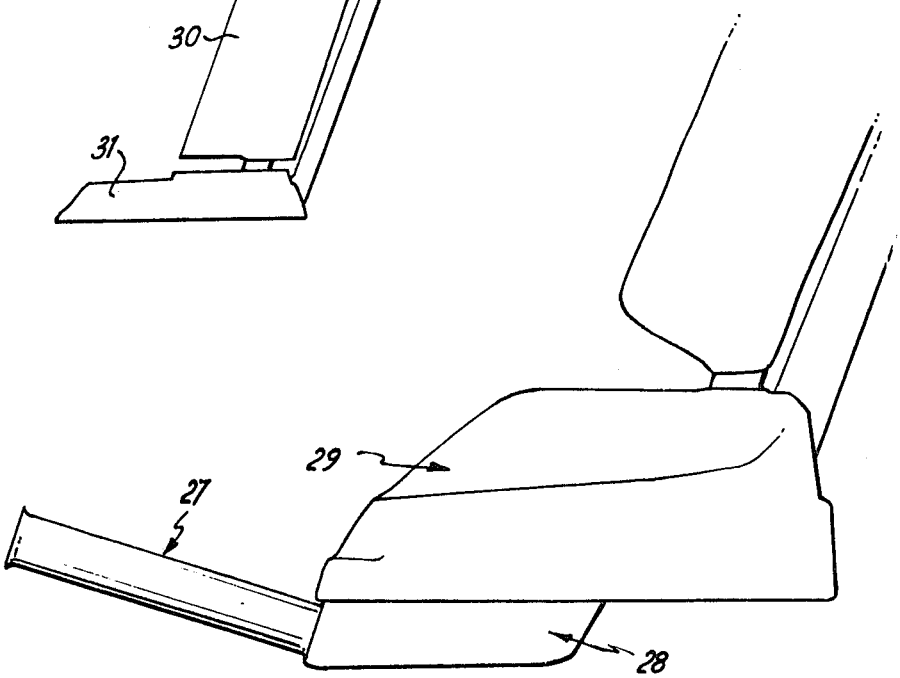

VACUUM CLEANERS

This invention relates to vacuum cleaning apparatus of the kind comprising a suction device to which in use are connected a flexible hose and a filtration device whereby contaminated fluid can be picked up with the hose and passed through the filtration device to remove contaminants therefrom. Such apparatus will be referred to hereinafter as vacuum cleaning apparatus of the kind described.

It is visualised that the invention will have particular application to vacuum cleaning apparatus of the kind described which is intended for use to remove dust from surfaces such as carpets by picking up dust-carrying air immediately above such surfaces. It is however to be understood that the invention is not intended to be restricted to this application, and the apparatus to which the present invention relates may be used for any other suitable purpose. Thus, for example, the apparatus may be used for cleaning water or underwater surfaces, as for example in swimming pools, in which case dirt-carrying water will be picked up.

With apparatus of the kind described, the problem arises that the flexible hose, when not in use, due to its necessary large operational length and good flexibility, may be difficult or inconvenient to store in a space saving, neat and conveniently transportable manner.

An object of the present invention is to overcome or at least minimise this problem.

According to the present invention therefore, there is provided vacuum cleaning apparatus of the kind described having a storage chamber within which at least a major part of said flexible hose can be inserted for storage of same when not in use.

With this arrangement it is possible for easy and convenient storage in a neat, space saving and conveniently transportable manner to be achieved.

Preferably, said chamber is in communication with said suction device and is arranged to act as a conduit linking the hose and the suction device when the hose is in use. In this way incorporation of the chamber in the cleaning apparatus can be particularly facilitated and, in addition, by appropriate formation and positioning of the chamber it is possible for the chamber to supplement effectively the length of the hose. Storage of the hose in the chamber may be arranged to be effected by power assisted traction of the hose into the chamber. Such power assistance may take any suitable form and thus for example may comprise a drum provided with a spring or other device, for example of the kind used with conventional electrical cable storing arrangements, whereby the drum can be rotated to wind the hose therearound. Most preferably however said power assisted traction is arranged to be effected under the action of suction exerted by the said suction device. In this way, a reliable, simple and extremely effective arrangement can be achieved.

The vacuum cleaning apparatus of the invention may in conventional manner comprise a main housing or body part which contains or supports the suction device and is also arranged to contain or support the filtration device which may be a filter bag or the like. Thus, for example, the apparatus may be of the 'cylinder' kind, having a main housing often of generally cylindrical form which in use is normally located at a convenient fixed position on or adjacent a surface to be cleaned and is connected to a remote pick-up head or other tool via a flexible hose. Alternatively the apparatus may be of the 'upright' kind, having a long handle structure connected to a wheeled base and which may be used either with or without a flexible hose, in the latter case the wheeled base acting as the dust pick-up head.

With apparatus of these kinds, the chamber may be a detachable or permanent structure applied to the exterior of the housing or body part, and this may be effected during manufacture of the apparatus or subsequently by modification of existing apparatus. Alternatively, the chamber may be incorporated in the body part or housing and thus for example may comprise an internal cavity or may form a structural part of the apparatus.

In accordance with a second aspect of the present invention there is provided a storable hose arrangement for use with apparatus as described above comprising a chamber having inlet and outlet ends, connection means at the inlet end for connecting the chamber to the suction device of the apparatus, and a flexible hose having a first end retained within the chamber in communication with the inlet end of the chamber and a second end extendible beyond the outlet end of the chamber, the hose being displaceable between a first position at which it extends ready for use beyond the outlet end of the chamber and a second position at which at least a major portion of the hose is stored within the chamber.

The chamber may take any suitable form in accordance with the desired disposition of the chamber and the hose within same. Thus the chamber may be of elongated form for example a straight tube, or it may be shaped to accommodate a hose in flat spiral or helical form.

In one embodiment of the invention the first end of the hose sealably cooperates with the chamber and the connection means is adapted to form a sealed connection between the chamber and the suction device. The first end of the hose may cooperate sealably with the chamber by engagement of a sealing structure at the first end of the hose with the inner surface of the chamber, said structure being slidable within the chamber between the inlet and outlet ends thereof and stops being provided at each end of the chamber to retain the sealing structure within the chamber. With this arrangement, most preferably closure means is provided at the second end of the hose whereby the hose can be drawn into the chamber by suction applied to the inlet end thereof when the second end of the hose is closed by the closure means. The closure means may comprise an end flap biased towards the closed position and a projecting part may be connected to the flap for use in moving same to an open position.

The hose may retain its full operational length when stored in the chamber but preferably the hose is of an expansible and contractible nature and is arranged to be stored in a contracted state within the chamber. The hose may be of a resilient nature tending to adopt an expanded state, and a retention device may be provided on the chamber for holding the hose in the contracted state when stored in the chamber.

The invention will now be described further by way of example only and with reference to the accompanying drawings in which:

FIG. 4 is a diagrammatic sectional view of an alternative form of apparatus according to the invention of the 'cylinder' kind; and FIGS. 5 and 6 are diagrammatic side views of two further forms of apparatus according to the invention of the 'upright' kind.

Figure 1:
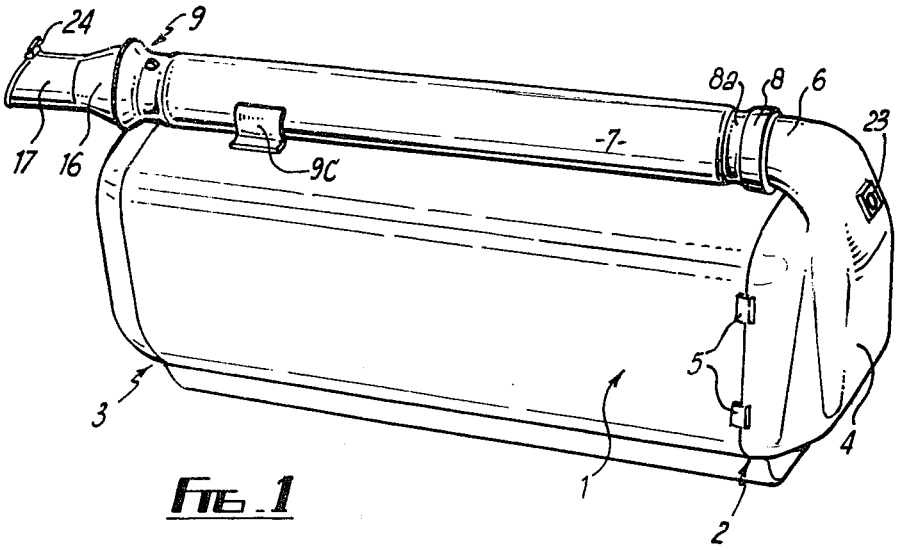
FIG. 1 is a perspective view of one form of apparatus according to the invention of the 'cylinder' kind with the hose in a stored position.
Figure 2:
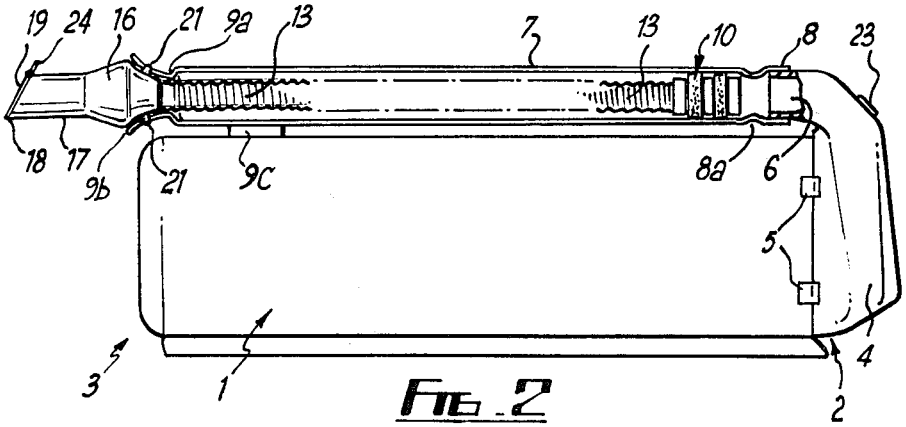
FIG. 2 is a part sectional view of the apparatus of FIG. 1.
Figure 3:
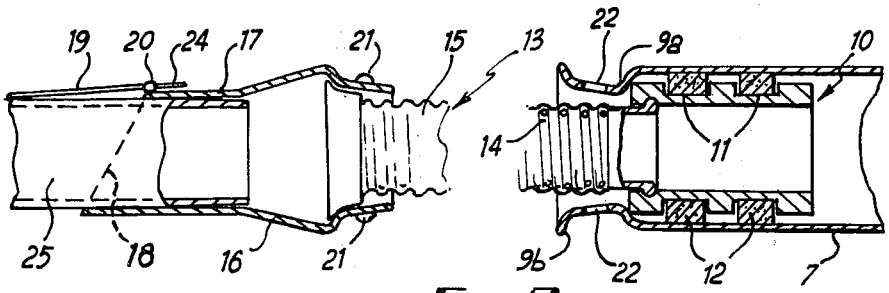
FIG. 3 is a sectional view to a larger scale showing the hose extended.

The apparatus of FIGS. 1 to 3 comprises a conventional domestic vacuum cleaner of the 'cylinder' kind having an elongated housing 1 of square cross-section with inlet and outlet apertures (not shown) at opposite ends 2,3 thereof. Inside the housing 1 there is an electric motor-driven air impellor (not shown) and a removable filter bag (not shown). In use the air impellor causes air to be sucked through the inlet aperture and through the bag. Entrained dust particles are retained in the bag and clean air is expelled through the outlet aperture.

At one end 2 of the housing 1, a cowling or funnel 4 is positioned over the inlet aperture and is held in position for example by means of spring clips 5. The cowling or funnel 4 tapers to a short sleeve 6 of circular cross-section which is located above the adjacent end 2 of the housing 1 and faces the opposite end 3 thereof.

A straight aluminium tube 7 of circular cross-section is connected at one end 8 to the sleeve 6 and extends along the top of the housing 1. The end 8 of the tube 7 fits tightly on to the sleeve 6 and is held in position for example by means of a bayonet connection. If desired, the tube 7 may be held in position on the top of the housing for example by means of a spring clip 9 and the length of the tube 7 is approximately equal to the length of the housing 1 whereby the end 9 of the tube remote from the sleeve 6 terminates slightly beyond the end 3 of the housing 1.

Adjacent its end 8, the tube 7 is pressed radially inwardly around the entire periphery of same 8*a* or at a number of positions spaced around the periphery. The tube 7 is similarly formed (at 9*a*) adjacent the other end 9 and in addition is turned outwardly at said end (at 9*b*).

Within the tube 7 there is positioned a moulded plastics sleeve 10 having two central peripheral grooves 11 (FIG. 3) in the outer surface of same. Rings 12 of foamed polyurethane or felt or like material are provided in the grooves 11 whereby the sleeve 10 forms a sealing structure slidable within the tube 7 between stops at each end defined by the inwardly pressed end portions 8*a*,9*a*.

At one end, the sleeve is secured, for example by welding or bonding, to one end of an extensible and contractible hose 13 which, as can be seen from FIG. 3, is formed from a helical coil spring 14 fitting tightly within a flexible tubular plastics sleeve 15. The other end of the hose 13 is secured to a rigid tubular end piece 16 located externally of the tube 7 and this end piece 16 is secured to a short, rigid tube 17 having an inclined free end 18. A disc 19 is pivotally mounted at the periphery of the free end 18 of the tube 17 and the pivotal mounting 20 incorporated a spring (not shown) which biases the disc 19 towards the closed position as shown in FIGS. 1 and 2 at which the disc 19 seals the free end 18 of the tube 17.

With the arrangement so far described, when the electric motor in the housing 1 is energised to provide a suction effect at the inlet aperture in the housing 1, such suction will be applied to the tube 7 and, due to the sealing effect at the connection between the end of the tube 7 and the sleeve 6, between the sleeve 10 and the inner surface of the tube 7, and at the free end 18 of the tube 17, it will be appreciated that the suction will cause the hose 13 to contract and be drawn into the tube 7. In this way it is possible to retract, for example, an eight foot hose into a two foot tube. When fully retracted, as shown in FIG. 2, the sleeve 10 engages the inwardly pressed portion 8*a* at the end 8 of the tube 7 and the end 16 piece abuts the outwardly turned rim 9*a* of the other end 9. Cooperating retention means in the form of a catch mechanism may be provided for holding the hose in the retracted state and this may comprise, for example, springy projections 21 on the end piece which spring into holes 22 or the like in the end 9 of the tube 7 when the hose 13 is fully retracted. In addition, if desired, a micro switch (not shown) may be mounted adjacent the end 9 of the tube so as to be operated by the end piece 16 when the hose 13 is fully retracted so as to switch off the motor of the apparatus.

The cowling 4 may be fitted with a valve 23, which may be adjustable, which acts as a bleed and/or pressure relief valve so that an excessively high pressure does not build up in the hose 13.

In the stored state of the hose 13 described above it will be noted that the hose 13 is stored in a neat, space saving and conveniently transportable manner. It will also be noted that such storage can be effected easily and quickly in so far as it is power assisted.

When it is desired to use the hose, it is only necessary to release the catch mechanism holding the end piece 16 to the end 9 of the tube 7 (as for example by manual displacement of the springy projections 21 mentioned above) and to reduce or eliminate the suction action in the tube 7 whereupon the hose 13 is free to be withdrawn from the tube 7. Preferably, the hose 13 is normally biased, by the action of its spring 14, to its extended state, so that the hose 13 can eject itself from the tube. If this is not the case it is possible for such ejection to be power assisted if desired.

The reduction or elimination of the suction effect may be achieved when the apparatus is switched on and operational by opening the closure disc 19. The disc 19 has a projecting finger 24 connected thereto and this can be operated manually to open the disc 19. As can be seen from FIG. 3, the disc 19 can be held open by fitting a conventional pick up head 25 or tool into the tube 17. Alternatively the tool may fit outside the tube 17 so that the tool engages the projecting finger 24 to open the disc 19.

In the extended state of the hose 13, the sleeve 10 can slide to the end 9 of the tube 7 until it engages the inwardly pressed portion 9*d*. The outwardly turned end 9*b* reduces wear of the hose 13 by rubbing against the tube end.

The embodiment shown in FIG. 4 incorporates a hose 13*a* and storage chamber 7*a* similar to those of the embodiment of FIGS. 1 to 3 but the chamber 7*a* is positioned internally of the housing 1*a* and in addition, an extension tube 26 is interposed between the chamber 7*a* and the hose 13*a*. With this arrangement, on application of suction to the sealed hose 13*a*, the hose 13*a* is retracted into the tube 26 and the tube 26 is retracted into the chamber 7*a*. The tube 26 acts as an extension piece and it is therefore possible to use a shorter hose 13*a*. Such an extension piece 26 can of course be used with other suitable embodiments, for example, with the embodiment of FIGS. 1 to 3.

A storable hose arrangement, incorporating a hose and external tube, similar to the arrangement of FIGS.

1 to 3, can be used in conjunction with other forms of cleaning apparatus. Thus, the arrangement may be used with a conventional 'upright' vacuum cleaner, the end of the tube being connected to the usual suction inlet provided for the attachment of tools.

FIG. 5 shows an alternative method of attaching such a storable hose arrangement to an upright cleaner. The arrangement 27 is connected to a cowling 28 which fits across the bottom of the wheeled base 29 of the cleaner.

FIG. 6 shows an upright cleaner of the kind having a suction motor mounted, together with the filtration bag, in an upper box structure 30 rather than in the wheeled base 31. A suction inlet extends from the base 31 to the top of the box structure 30.

A storable hose arrangement 32, for example similar to that shown in FIGS. 1 to 3, may be incorporated in the handle of the cleaner and in fact may form the top end part of the handle. The arrangement 32 may be permanently or selectively connectable to the suction inlet and means may be provided for shutting off the base 31 from the suction inlet.

It is of course to be understood that the invention is not intended to be restricted to the details of the above embodiments which are described by way of example only.

What we claim is:

1. A vacuum cleaning apparatus of the kind comprising a suction device connected to a suction inlet and to a filtration device whereby contaminated fluid can be drawn through said inlet and passed through said filtration device to remove contaminants therefrom, said apparatus having:

an elongated chamber having first and second ends, said first end being connected to said suction inlet;

a resiliently extensible and contractable flexible hose self-biased to an extended state having first and second ends, said first end of the hose being held captive within said chamber and in sealed communication with the first end of the chamber and said second end of the hose being extendable beyond the outlet end of the chamber and being adapted for detachable attachment of a contaminated fluid pick-up tool thereto; cooperating retention means on the second end of the chamber and on the second end of the hose for releasably holding the second end of hose in retracted position at the second end of the chamber against said self-bias;

and closure means at said second end of the hose which is opened on connection of said tool to said second end and which can be closed to seal the hose on detachment of the tool;

whereby on release of said retention means and opening of said closure means the hose is extended from the chamber in response to the extensive self-bias thereof and on closure of said closure means the hose is contracted and drawn back into said chamber by suction from the suction device overcoming said extensive self-bias to be held therein by the retention means.

2. An arrangement according to claim 1 wherein the chamber comprises a straight tube.

3. An arrangement according to claim 2 wherein the first end of the hose cooperates sealably with the chamber by engagement of a sealing structure at the first end of the hose with the inner surface of the chamber, said structure being slidable within the chamber between the inlet and outlet ends thereof and stops being provided at each end of the chamber to retain the sealing structure within the chamber.

4. An arrangement according to claim 3 wherein the closure means comprises an end flap biased towards the closed position and a projecting part is connected to the flap for use in moving same to an open position.

5. The vacuum cleaning apparatus according to claim 4 wherein said projecting part is arranged to be manually engaged so as to cause said flap to be moved to the open position.

* * * * *